United States Patent [19]

Desbrandes

[11] Patent Number: 5,056,595

[45] Date of Patent: Oct. 15, 1991

[54] WIRELINE FORMATION TEST TOOL WITH JET PERFORATOR FOR POSITIVELY ESTABLISHING FLUIDIC COMMUNICATION WITH SUBSURFACE FORMATION TO BE TESTED

[75] Inventor: Robert Desbrandes, Baton Rouge, La.

[73] Assignee: Gas Research Institute, Chicago, Ill.

[21] Appl. No.: 565,705

[22] Filed: Aug. 13, 1990

[51] Int. Cl.[5] ..... E21B 49/10

[52] U.S. Cl. ..... 166/100; 73/155; 166/264

[58] Field of Search ..... 166/100, 264, 250; 73/155

[56] References Cited

U.S. PATENT DOCUMENTS

| | | | |
|---|---|---|---|
| 3,169,578 | 2/1965 | Voetter | 166/100 X |
| 3,217,804 | 11/1965 | Peter | 166/100 |
| 3,254,531 | 6/1966 | Briggs, Jr. | 166/264 X |
| 3,269,462 | 8/1966 | Voetter | 166/100 |
| 3,430,181 | 2/1969 | Ubanosky | 166/100 X |
| 3,677,081 | 7/1972 | Newton et al. | 166/100 X |
| 4,635,717 | 1/1987 | Jageler | 166/250 |
| 4,742,459 | 5/1988 | Lasseter | 73/151 X |
| 4,860,581 | 8/1989 | Zimmerman et al. | 73/155 |
| 4,962,665 | 10/1990 | Savage et al. | 73/155 |

*Primary Examiner*—Hoang C. Dang

*Attorney, Agent, or Firm*—Llewellyn A. Proctor

[57] ABSTRACT

A wireline tool, and process for its use, for lowering into wellbores for testing the gas pressure, and connate fluid flow rates, in low permeability oil or gas producing subsurface formations. The tool features a jet charge perforator for detonation to perforate through the wall and positively establish fluidic communication with the non damaged portion of the subsurface formation to be tested. It also includes, in the combination, a mechanism for affixing and stabilizing the tool in the wellbore at the wall of the subsurface formation to be tested, inclusive of a packer assembly for isolating from wellbore fluids the opening between the subsurface formation, created by the jet perforator, and tool test components. On blasting into the wall of the subsurface formation, the pressure in the flowline is maintained at formation pressure, avoiding formation damage. The pressure is recorded during the flow of gas and connate fluids from the subsurface formation, and analysis is made of a specimen taken into a chamber of the test tool.

17 Claims, 5 Drawing Sheets

WIRELINE FORMATION TEST TOOL WITH JET PERFORATOR FOR POSITIVELY ESTABLISHING FLUIDIC COMMUNICATION WITH SUBSURFACE FORMATION TO BE TESTED

FIELD OF THE INVENTION

This invention relates to a process and apparatus for testing the gas pressure, and connate fluid flow rates, in an oil or gas producing formation. In particular, it relates to an improved wireline testing tool, or apparatus, for lowering into wellbores for testing the gas pressure of subsurface formations, and connate flow rates, especially in low permeability formations.

BACKGROUND

The invasion and impairment of petroleum and gas producing formations by particulate matter is a well known and costly problem in the oil and gas industry. The invasion and the associated depth of penetration of solids particles into the porous media, which results in plugging the pore spaces, has tendered a broad spectrum of explanations; but the phenomenon is far less than completely understood. Consequently, the proposed remedial treatments are not always successful, if at all.

In drilling and producing oil or gas it is necessary to form a borehole or wellbore by drilling into the earth, and to balance the formation pressure with a drilling fluid or "mud." These fluids, or muds, are commonly aqueous liquids within which there is dispersed clays or other colloidal solids materials. A drilling fluid also serves as a lubricant for the bit and drill stem, and as a carrying medium for the cuttings produced by the drill bit. If oil or gas are found and the oil or gas can be produced in commercial quantities the well is completed. Usually a casing is run from the surface downwardly, set and cemented. The hole is drilled to a depth below the producing formation, and the casing is set to a point near the bottom of the hole. The producing formation is sealed off by the production string and cement, and perforations made in the strata so that the oil or gas can flow into the wellbore. Perforations are made through the casing and cement, and these are extended some distance into the producing formation. A small diameter pipe, or tubing, is then placed in the well generally concentric with the casing to carry the oil or gas product to the surface.

The presence of the drilling fluid, or wellbore fluids generally, also assists in the formation of a crust, or mudcake, on the wall of the wellbore and results in the reduction of fluid losses to the surrounding subsurface strata. Unfortunately however, the presence of particulate solids or fines, in the wellbore fluids also results in pluggage of the pore throats in the wall of the producing formation. Pluggage of these openings or passageways will prevent the conveyance of oil or gas to the wellbore for transport to the surface. The presence of particulate solids transported from within a producing formation to the surface wall of the wellbore also provides a mechanism which may account for this type of pluggage.

It is recognized, in any event, that the absolute pressure within an oil or gas producing formation is directly related to the ability, and duration, of the formation to produce oil or gas. A high formation pressure evidences a formation that contains a large volume of gas. Formations that contain large volumes of gas will produce, and continue to produce, oil or gas. Low pressure, on the other hand, manifests a formation where there is very little gas to drive the oil from the formation, or little or no gas to be produced. Wireline formation testers, as a class, are known for lowering from the surface to a subsurface formation to be tested. A tool of this type includes a fluid entry port, or tubular probe cooperatively arranged with a wall-engaging pad, or packer, which is used for isolating the fluid entry port, or tubular probe from the drilling fluid, mud, or wellbore fluids during the test. The tool, in operating position, is stabilized via the packer mechanism within the wellbore with the fluid entry port, or tubular probe, pressed against the wall of the subsurface formation to be tested. Gas, or other fluid, or both, is passed from the tested formation into the fluid entry port, or tubular probe via a flow line to a sample chamber of defined volume and collected while the pressure is measured by a suitable pressure transducer. Measurements are made and the signals electrically transmitted to the surface via leads carried by the cable supporting the tool. Generally, the fluid pressure in the formation at the wall of the wellbore is monitored until equilibrium pressure is reached, and the data is recorded at the surface on analog or digital scales, or both.

These types of tools have generally served satifactorily, though they are not without their shortcomings. Low permeability formations cannot be effectively tested with the known generally standard low flow rate formation testers, or these types of testers consistently fail after some initial successes before a problem develops. These testers, it has been found, fail to make a good fluidic connection with the formation to be tested. This failure, it is believed, is due to damage to the formation by drilling fluids, or mud solids particles may enter deeply into and plug pore spaces so that no fluid flow can occur. The formation itself, on the other hand, may contain some clay particles in the pore space, and, when a large drawdown pressure is imposed on the formation, those particles may move and plug the pore throat; again, preventing the flow of fluid from the formation. Imperviousness at the wellbore surface for a depth of a fraction of an inch to two inches, it is found, is adequate to choke off the flow of fluids from the formation to be tested.

OBJECTS

It is, accordingly, the primary objective of this invention to provide an improved apparatus, and process, for testing the gas pressure in oil or gas producing formations.

In particular, it is an object to provide an improved wireline testing apparatus for lowering into wellbores for testing the gas pressure, and the flow rate of connate fluids in subsurface formations.

A further and more specific object is to provide an improved wireline testing apparatus of this type, particularly one which is useful for testing the gas pressure, and flow rate of connate fluids in low permeability formations.

THE INVENTION

These objects and others are achieved in accordance with this invention, an apparatus embodiment of which includes in the overall combination, a jet perforator for detonation at the wall of the subsurface formation to create a hole, or passageway, into the formation for positively establishing fluidic communication with said formation, particularly a low permeability subsurface formation, which is to be tested. The apparatus combination includes the usual tool body, and passageway into the tool body which houses test components which include a pressure gage, and at least one test chamber for testing the flow rate of connate fluids introduced into the passageway from the subsurface formation. The tool also contains the usual means for affixing and stabilizing the tool body in the wellbore at the level of the formation to be tested, this including an extensible packer assembly, and pad with pad opening adapted for sealing engagement and alignment of the pad opening with the passageway into the tool to isolate same from wellbore fluids, and to establish a path for fluid communication between the subsurface formation and the tool body passageway. The improvement in this overall combination further requires the use of a jet perforator, inclusive of a firing chamber within which an explosive charge can be placed, and detonated, to perforate through the wall of the subsurface formation. The firing chamber, preferably of conical shape, is contained within a housing, with its open end aligned upon and facing the wall of the formation to be tested. The housing, preferably, further includes a fluid-filled chamber in front of the firing chamber, and one or more pistons for maintaining pressure thereon. On detonating the charge the walls of this chamber are perforated, and opened up to the formation which is also perforated by the explosion. Fluid from the fluid-filled chamber fills the firing chamber, and the hole formed by the jet. A small excess of fluid, compatible with the formation, may enter the formation. Connate fluids from the formation flow via the passageway provided by the fluid-filled chamber to establish a positive flow between the formation and the passageway in the body of the tool, for testing.

The use of the jet perforator for detonation at the wall of the subsurface formation to create a hole, or passage into the formation, as part and parcel of the combination, makes it possible to test low permeability formations which cannot be tested by the more conventional or low flow rate formation testers. These latter often fail to make good fluidic connection with the formation to be tested because the wall at the surface of the subsurface formation to be tested has often become clogged with particulate solids, and made impervious to the flow of fluids from inside the formation. Blasting a hole in the wall back into the formation for a distance of one to two inches, it has been found, is generally adequate to perforate through the damaged zone, to open up and establish fluidic communication between the subsurface formation and the tool interior within which gages and test components are provided to measure pressure, and connate fluid flow rates. Maintaining a backpressure immediately after blasting the hole prevents application of a large drawdown pressure gradient to the formation when the gases from the jet cool off. Thus, the naturally occurring particulate solids of the formation do not move to plug the pore throats.

A preferred apparatus, process, and the principles of operation of said apparatus, and process, will be more fully understood by reference to the following detailed description, and to the drawing to which reference is made in the description. The various features and components in the drawing are referred to by numbers, similar numbers and components being represented in the different views by similar numbers. Subscripts are used in some instances with members where there are duplicate parts or components, or to designate a subfeature or component of a larger assembly.

REFERENCE TO THE DRAWING

Figure 2:
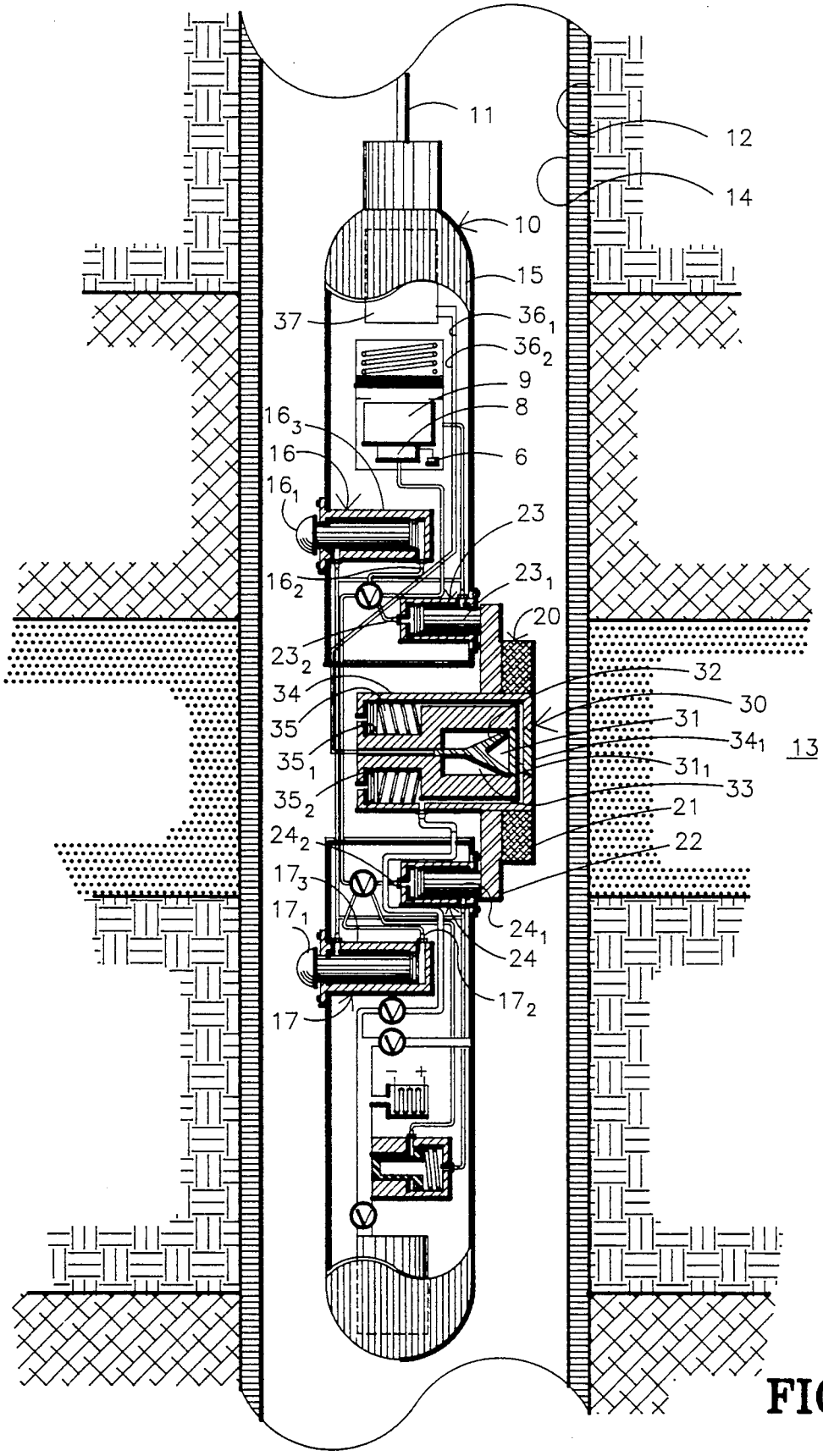
FIG. 2 depicts, in a somewhat enlarged view, the wireline testing tool with an external wall removed to expose various subassemblies, and these are shown in section.
Figure 3:
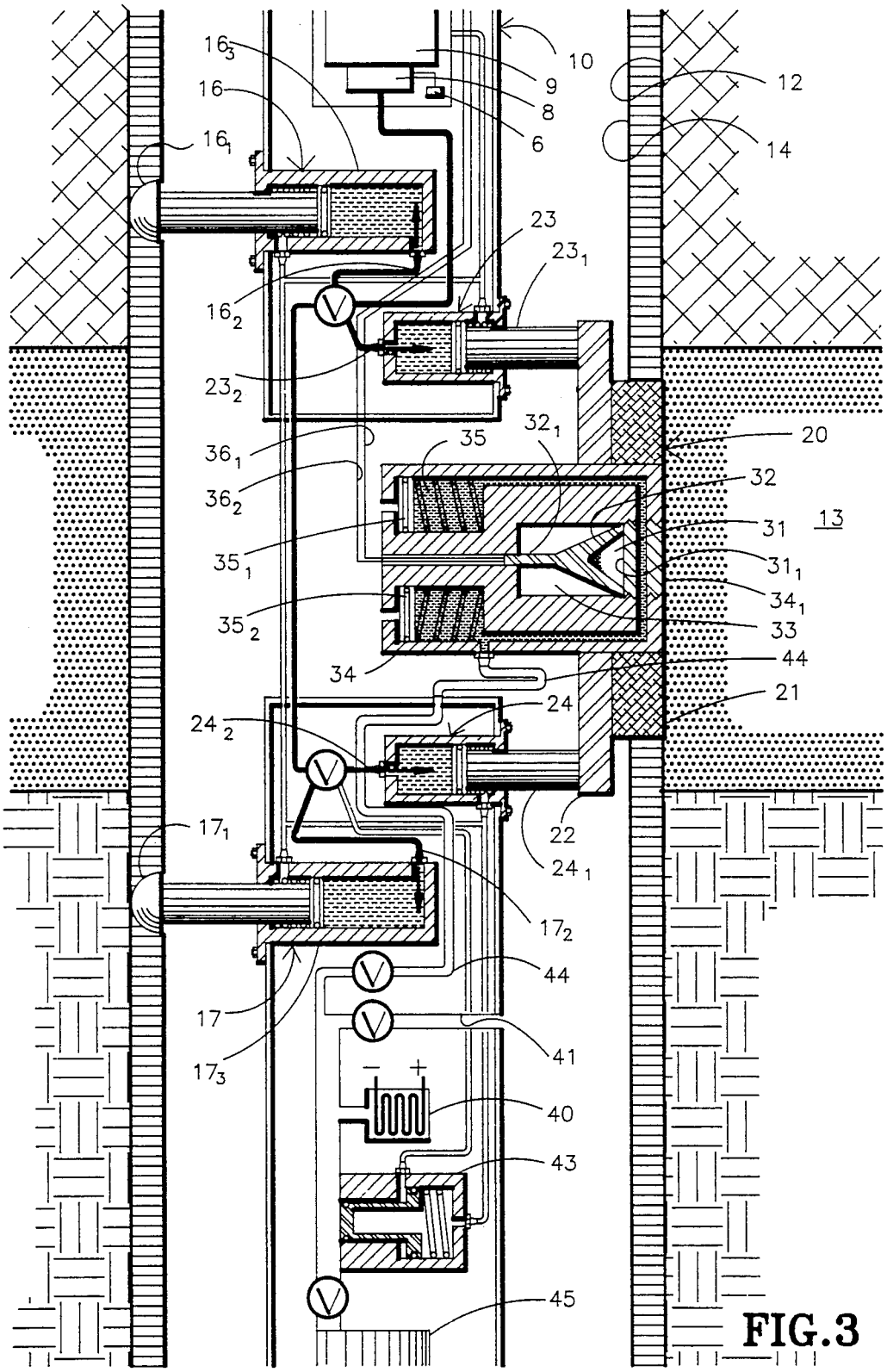

FIG. 3 presents a further enlargement of the wireline testing tool depicted in FIG. 2, this view permitting better focus on that portion of the mechanism, as part of the overall combination, which provides means for establishing a fluidic communication with a subsurface low permeability formation to be tested. In this figure, unlike the preceding figures, the tool has been affixed within the wellbore via the extension of stabilizing means into contact with the surrounding wall of the wellbore.

Figure 5A:
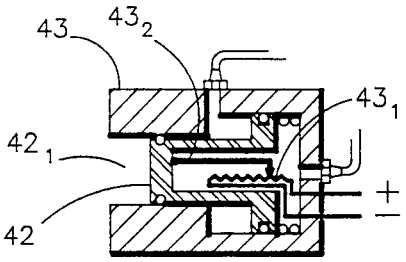
Figure 4:
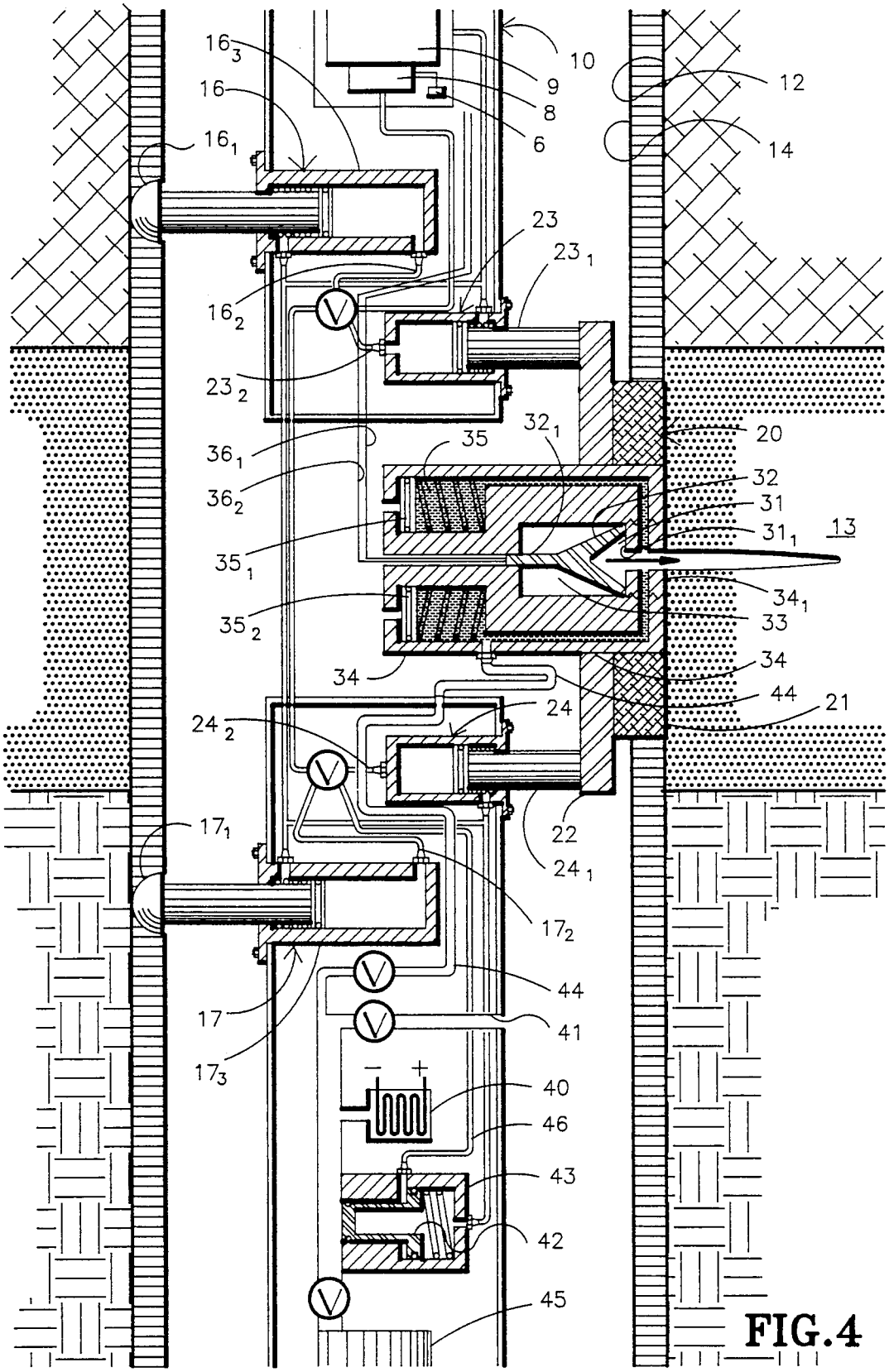
Figure 5:
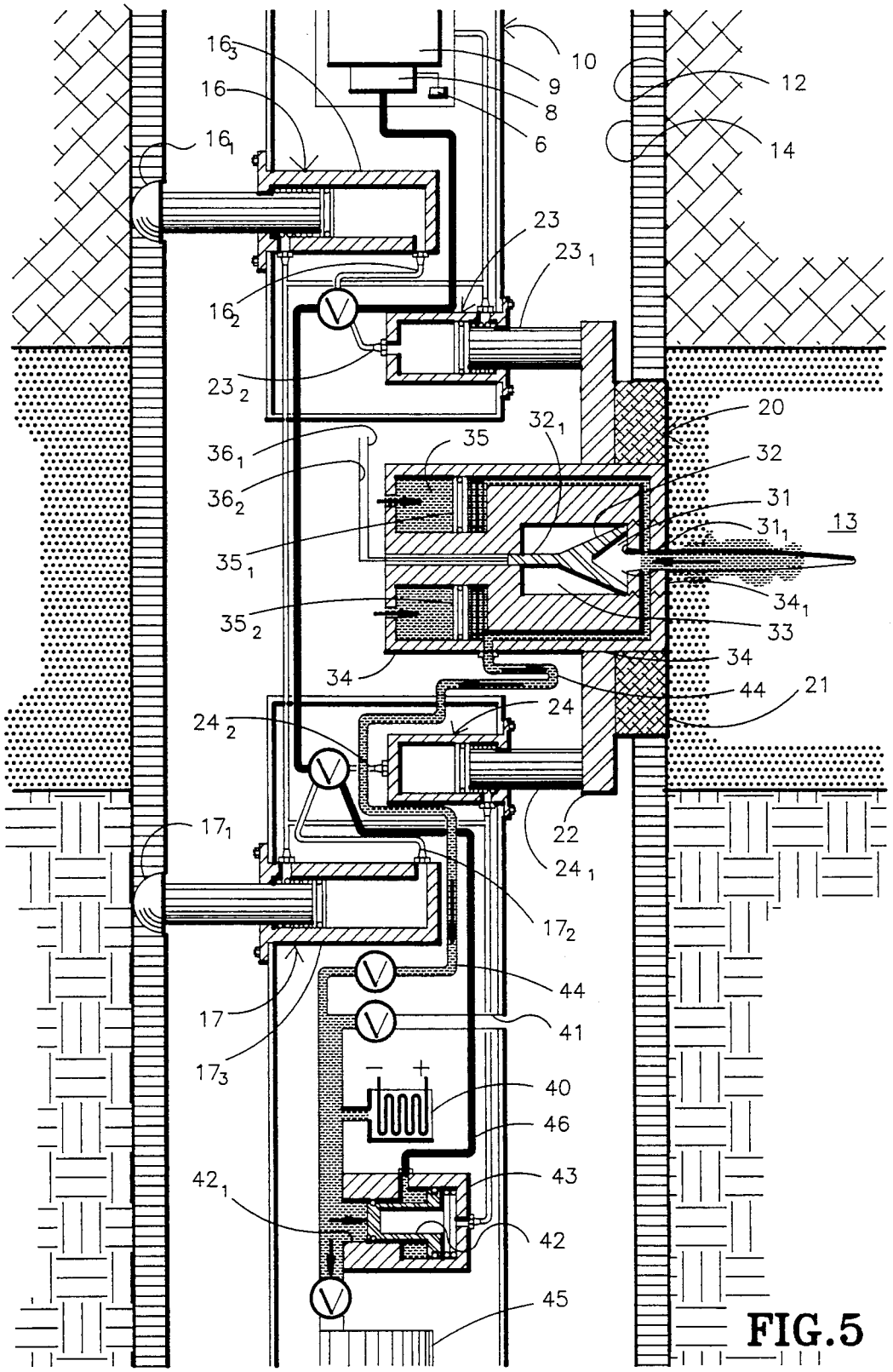

FIGS. 4 and 5, taken with the preceding figures, provide a series of progressive views which exemplify the procedure employed in operation of the tool in establishing fluidic communication with a subsurface formation, testing for gas pressure, and withdrawing connate fluids from the formation.

FIG. 5A is a fragmentary view depicting a feature of the apparatus best shown by reference to this figure.

Figure 6:
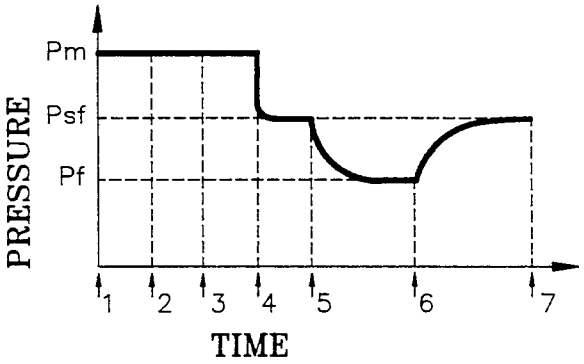

FIG. 6 depicts graphically a method of operation of the tool.

Figure 1:
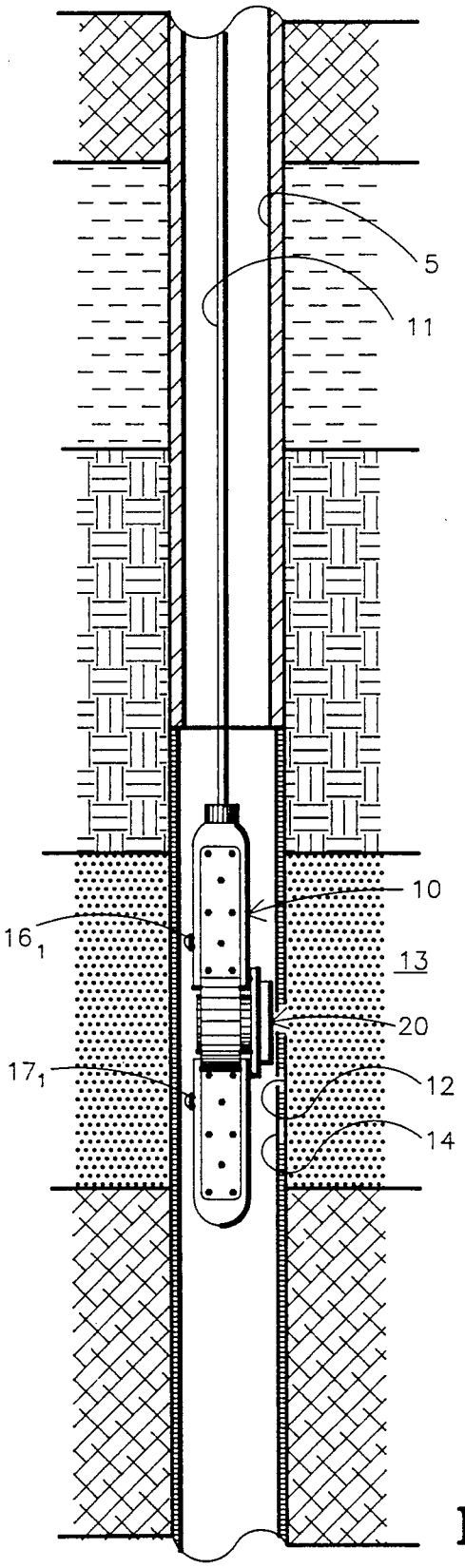
FIG. 1 depicts a novel, improved type of wireline testing tool useful for testing the gas pressure, and flow rate of connate fluids, in a subsurface formation. The tool in this instance is suspended via a cable within a wellbore, after having been lowered from the surface through a number of formations.

Referring first to FIG. 1, generally, there is shown a wireline testing tool 10, as the tool would appear after it had been lowered from the surface through a series of subsurface foundations and wellbore casing 5 on a multiconductor cable 11 into a fluid or mud filed wellbore 12, or borehole, to a level opposite a specific subsurface formation 13 to be tested. The tool 10 is suspended in the mud filled borehole 12 from the lower end of the multiconductor cable 11 that is conventionally spooled at the surface on a suitable winch and coupled to a tool control system, recording and indicating apparatus, and power supply, not shown. Control signals are electrically transmitted from the surface, and measurements made with the tool 10 are transduced into electrical signals and transmitted as data via the multiconductor cable 11 to the surface recording and indicating apparatus; this generally including both analog and high resolution digital scales. Control from the surface permits operators to place the tool 10 at any of a number of operating positions, and to selectively cycle the tool from one position to another as may be required. These control mechanisms per se for control and manipulation of the tool from the surface are conventional, as are the data gathering and recording techniques.

Continuing the general reference to FIG. 1, and also to FIG. 2, the tool 10 is constituted of an elongated body formed by an enclosing wall 15. At about the mid section, and on one side of the elongated body there is located a pair of selectively extendible anchoring piston $\mathbf{16}_1$, $\mathbf{17}_1$ and on the opposite side thereof a packer assembly 20, which includes a pad 21 which is also extendible outwardly from the surface of the body 15 via a pair of laterally movable pistons $23_1$, $24_1$. The simultaneous extension of the pistons $16_1$, $17_1$ and pad 21 from within the body of the tool 10, via actuation of pistons $23_1$, $24_1$, for contact with the surrounding wall 12 of the subsurface formation 13, e.g., as illustrated by reference to FIG. 3, locks and stabilizes the tool 10 in place for operative analysis. Moreover, the pad 21 provides a means for sealing off a selected portion of the wall of borehole 12 from the wellbore fluid, or mud, and a path, or passageway, established between the tool 10 and subsurface formation 13 by setting off the jet charge to perforate the formation so that fluid may be transferred from inside the formation 13 to the tool for analysis.

A hydraulic system, which includes a motor 9, pump 8 and reservoir 6, per se of conventional design is operatively connected to a manifold, through multiport valved connections, provide the hydraulic power required for actuation of the pistons $16_1$, $17_1$, and pistons $23_1$, $24_1$ of the packer assembly 20. The pistons $16_1$, $17_1$ are components of hydraulically actuated cylinder-piston units 16, 17. Hydraulic fluid, under pressure, introduced via lines $16_2$, $17_2$ into the rearward ends of the housings of the cylinder-piston units 16, 17 as shown by reference to FIG. 3 produce extension of the pistons $16_1$, $17_1$ from within their enclosing housings, or cylinder $16_3$, $17_3$. The helical springs seated in the forward ends of the cylinder-piston units 16. 17 are compressed so that on reversal of the applied pressure, and release of the applied pressure, the pistons $16_1$, $17_1$ are withdrawn or retracted into their respective cyclinders or housings. Suitably, double acting cylinder-piston units can be employed, i.e., hydraulic fluid could be alternately applied to the two ends of a cylinder $16_3$, $17_3$, respectively, to extend and retract a piston $16_1$, $17_1$, respectively.

The packer assembly 20 is constituted of a sealing pad 21, a support plate 22 on which the pad 21 is mounted, and a pair of hydraulically actuated pistons $23_1$, $24_1$ via means of which the pad 21 can be extended, simultaneously with pistons $16_1$, $17_1$ into contact with the wall surface of the borehole 12, to affix and stabilize the tool 10 within the borehole. Conversely, when required, these pistons can be retracted simultaneously with pistons $16_1$, $17_1$ to release the tool 10 which has been affixed, and stabilized at a selected position within the borehole 12. Extension of the pistons $23_1$, $24_1$, as best observed by reference to FIG. 3, is accomplished by the introduction of hydraulic fluid into the rearward ends of the housings 23, 24 of these units via lines $23_2$, $24_2$. Retraction of the pistons $23_1$, $24_1$ occurs via the introduction of pressurized hydraulic fluid into the opposite side of the housings of the cylinder-piston units 23, 24. Besides this function, the packer assembly 20, after the tool 10 has been lowered from the surface to a level opposite a wall of the targeted subsurface formation 13, is used to seal off from borehole fluid, or mud, a selected portion of the borehole wall 12, with its mudcake lining 14, and provide a path for blasting an opening, or passageway, into a selected portion of the wall of subsurface formaton 13 so that fluid may be transferred from within the subsurface formation and taken into the tool for testing.

The jet perforator subassembly, or jet perforator 30, provides the means for perforating through the wall of the formation to connect the non damaged interior of the formation to the testing components of the tool 10. At the heart of the jet perforator 30 lies a firing chamber 31 of conical shape, formed by the forwarding diverging open ended wall of the generally conical shaped block 32 located within a cylindrical shaped opening, or inner chamber 33, in the forward face of the housing 34. The housing 34 is affixed at its forward end to the packer assembly 20, via attachment to the support plate 22 at the opening therethrough, and is laterally movable therewith. Projection of pistons $23_1$, $24_1$ outwardly, which moves the pad 21 of the packer assembly 20 into contact with the surface of the wellbore, thus carries with it the housing 34. Conversely, retraction of pistons $23_1$, $24_1$ inwardly carries the housing 34 in the opposite direction.

Within the housing 34 of the jet perforator subassembly 30, best shown by reference to FIGS. 2 and 3, there is provided an outer "U-shaped" chamber 35 which extends from the rearward end to the forward end, and from the forward end back around to the rearward end of the housing 34. The two rearward ends of the U-shaped chamber 35 are of enlarged cylindrical shape, and reciprocably movable pistons $35_1$, $35_2$, actuatable by mud pressure, are mounted therein. The U-shaped chamber 35, in operative use, is filled with a fluid which is compatible with connate fluids such as would be contained within a subsurface formation 13. A shaft portion $32_1$ of the conical shaped block 32, within which is provided the forwardly faced firing chamber 31, is mounted via extension into an opening within the rearward end of chamber 33, and electrical leads $36_1$, $36_2$ are projected outwardly through the rearward end of the housing 34, these extending upwardly to a power supply 37. The explosive charge is placed in the chamber 31 at the surface, and enclosed therein by a circular, externally threaded retaining plate $31_1$, threadably engaged to the internally threaded interior portion of housing 34 in front of the conical shaped block 32. Fluid is charged into, and retained within the chamber 35 after the charge and circular retaining plate $31_1$ are in place. This is done via closure of the chamber 35 with the outer circular retaining plate $34_1$.

In effect therefore, the packer assembly 20 of the tool 10 carries a chamber 31 in which can be placed an explosive charge. The tool 10 can be lowered in place opposite a subsurface formation 13, the packer assembly 20 with its charge containing chamber 31 projected against the wall of the formation 13 to isolate the packer 20 from wellbore fluids, and the charge detonated via command from the surface. On detonating the charge, the force of the explosion cuts a hole through the two circular plates $31_1$, $34_1$ and perforates the formation; perforating through the damaged wall to connect the non damaged interior of the subsurface formation 13 with the testing components of the tool. The chamber 31 which contains the jet charge, prior to detonation, is maintained at approximately atmospheric pressure. The fluid in chamber 35, between the two plates $31_1$, $34_1$, is maintained at a pressure approximately equal to the hydrostatic pressure of the wellbore fluid, or mud, at the depth of the tool 10. The volume of the fluid in chamber 35 is adequate to fill up the chamber 31 and hole created by firing the charge, but inadequate to invade appreciably the formation in the vicinity of the jet hole created by the explosion. Accordingly, as shown, e.g., by reference to FIG. 4, after explosion of the jet charge a hole is opened through plates $31_1$, $34_1$ into the formation. Fluid from chamber 35 fills chamber 31 as pistons $35_1$, $35_2$ are driven forward. Formation pressure exits therefrom into line 44 which leads to the test components. Chamber 35, and line 44 remain closed to wellbore fluids, or mud, by the sealing action of pistons $35_1$, $35_2$ and packer assembly 20.

Reference is made to FIGS. 3, 4 and 5. In each of these figures the pad 21 of the packer assembly is pressed against the wall of the subsurface formation 13, this sealing off and effectively isolating the chamber 35, line 44, and test components within the line 44 inside the tool from wellbore fluids. After perforation of the formation, specifically as shown in FIGS. 4 and 5, connate fluids from within the formation 13 flow via chamber 35 through the valved line 44, the sample chamber 43 being gradually opened to increase the rate of flow, or gradually closed to restrict the rate of flow, as required. As the pressure builds up within the line 44 its value is registered, and measured, on the pressure gage 40 and this value electrically transmitted to the surface via connection with the multicable 11, via means not shown. Fluids transported via the now open portion of chamber 35 and line 44 past the mud equilibrium line 41 are drawn into the entry side $42_1$ (FIG. 5) of the sample chamber 43, a hydraulically actuated double-acting cylinder piston unit, via the retraction of piston 42. The rate of flow of the fluid into the sample chamber is measured, and the values electrically registered with potentiometer $43_1$ (FIG. 5A) and continuously transmitted to the surface via connection with the multicable 11, via means not shown. The numeral 45 represents a sample chamber capable of measuring the flow rate of a larger volume sample of connate fluids drawn from the subsurface formation. The sample chamber 45, shown essentially in block form, is capable of greater accuracy because of its larger volume, but it is otherwise identical in design and function with sample chamber 43.

In operation, the tool 10 is lowered into a wellbore to a level opposite the subsurface formation and the tool affixed on command from the surface to the formation via extension of the pistons $16_1$, $17_1$, $23_1$, $24_1$; extension of pistons $23_1$, $24_1$ also extending the pad 21 of the packer assembly 20 against the wall of the subsurface formation to isolate from the wellbore fluids the passageway into the housing that will be created by firing the jet charge. The steps employed in the operation of the tool 10, after the tool 10 has been set in place, and stabilized with the packer assembly 20 extended against the wall of the formation 13 are graphically illustrated by reference to FIG. 6. Time is represented on the x-axis, time increasing from left to right on the scale; incremental steps $t_1$ through $t_7$ representing manipulative steps as subsequently explained. Pressure is represented on the y-axis, $P_M$ representing the pressure of the mud, $P_{SF}$ representing sand face pressure, or pressure at the face of the formation, and $P_F$ representing the flowing pressure. $P_{SF}-P_F$ represents the drawdown pressure which should not exceed about 500 pounds per square inch, preferably about 200 psi to prevent the movement of natural solid particles.

At $t_1$ valved line 44 is opened to admit mud pressure to gage 40 via chamber 35 and passageway 44. Thus, at time $t_1$ as shown in FIG. 6, the mud pressure on the pressure gage 40 is read as $P_M$. The valve in line 44 is then closed to protect pressure gage 40 from excessive pressure as will be produced on setting off the charge. Closure of the valve at this time is represented at $t_2$ on the graph at FIG. 6. The jet charge is then fired from the surface to cut holes through plates $31_1$, $34_1$ and perforate the formation, this connecting the non damaged portion of the formation with chamber 35 and line 44. This, the perforation step, is represented at $t_3$ on the graph. The valve in line 44 is then gradually opened to measure sand face pressure, $P_{SF}$, as illustrated at $t_4$ of the graph at FIG. 6. The sample chamber 43 is then gradually opened to provide a slow flow drawdown from the formation while maintaining a flow pressure slightly lower than the sand face pressure of the formation. It is necessary to flow at a slow flow rate to determine permeability and prevent the naturally occurring particulate solids from moving and plugging the pore throats of the formation. The drawdown, begun at $t_5$ as represented by the graph is completed at $t_6$. At $t_6$ the flow is stopped and the pressure again permitted to build up, as depicted by the change on the graph between $t_6$ and $t_7$, for check of the permeability and sand face pressure. (A difference between the two pressure readings may indicate supercharging of the formation.) Where it is desired to obtain a more precise flow rate measurement, the larger chamber 45 can be used for making the measurements.

The flow rate necessary to maintain flowing pressure is measured by the amount of fluid, and time required for the measured amount of fluid to enter the chamber 43 (or sample chamber 45). This measurement can be made via use of a linear potentiometer $43_1$ as schematically depicted by reference to FIG. 5A. Connate fluid from the subsurface formation fills the tubular entry portion $42_1$ of the sample chamber 43, displacing the volume vacated by the withdrawing plunger 42, actuated by flow of hydraulic fluid into the separated rearward chamber thereof via line 46. The change in position of the plunger 42 is registered on the fixed scale $43_1$ as the contact $43_2$ is moved to follow the movement of the plunger 42, and the signal electrically transmitted via multicable 11 to the surface. As suggested, a larger sample is collected, and determination made via the use of sample chamber 45 where appropriate.

It is apparent that various modifications and changes can be made without departing the spirit and scope of the invention. For example, the tool could be provided with a plurality of pad assemblies to perform a number of different tests during the same trip to the borehole. Or, instead of utilizing mud pressure to drive the pistons of the U-shaped chamber 35, hydraulic power could be directly applied to the pistons $35_1$, $35_2$ to drive the pistons forward when the cavity provided by the firing chamber is being filled, or to fill the hole formed by the jet charge as the gases cool.

Having described the invention, what is claimed is:

1. In a wireline formation test tool for suspension via a cable from the surface into a fluid filled wellbore for testing a low permeability subsurface formation wherein there is included a body, a passageway into the body which is communicated with a pressure gage, and at least one sample chamber for testing the flow rate of connate fluids introduced into the passageway from the subsurface formation, and means for affixing and stabilizing the tool body in the wellbore at the level of the subsurface formation to be tested, which includes an extensible packer assembly, inclusive of a packer pad with openings, adapted for sealing engagement by projection of the pad of the packer assembly against a wall of the formation to be tested, and alignment of the pad opening with said passageway for isolation of said passageway of the tool body from wellbore fluids to establish a path for fluid communication between said passageway and the subsurface formation, the improvement comprising a jet perforator assembly, inclusive of a housing containing an open end firing chamber within which an explosive charge can be placed, the open end of the firing chamber being aligned upon and facing the wall of the formation to be tested, a fluid-fillable chamber in front of the firing chamber with one or more pistons mounted therein for applying pressure upon a fluid placed therein, and the volume thereof is substantially equal to that of the firing chamber, such that detonation of the explosive charge within the firing chamber will perforate the wall, penetrate said fluid-filled chamber, perforate said formation and connect the formation with said fluid-filled chamber, the fluid will fill the firing chamber, and establish a positive flow of connate fluids from the subsurface formation through said passageway into the body of the tool, for testing.

2. The apparatus of claim 1 wherein the packer assembly is extensible via means of a pair of spaced apart pistons located on one side of the tool body, which is elongate and houses the passageway, pressure gage and sample chamber, and the pad is located on the outside of a support member affixed to the projecting ends of said pistons.

3. The apparatus of claim 2 wherein the pistons are hydraulically actuated.

4. The apparatus of claim 1 wherein the means for affixing and stabilizing the tool further includes a pair of spaced-apart pistons disposed on a side of the tool body opposite that one which the packer assembly is located.

5. The apparatus of claim 4 wherein the additional pair of pistons is hydraulically actuated.

6. The apparatus of claim 1 wherein the housing of the jet perforator assembly is affixed to the packer assembly, and movable therewith such that the jet perforator assembly is positioned for perforating the subsurface formation to be tested when the pad of the packer assembly is extended and thrust against the wall of the subsurface formation to be tested.

7. The apparatus of claim 1 wherein the firing chamber of the jet perforator assembly is of conical shape, and the fluid-fillable chamber in front of the conical shaped opening of the firing chamber is of U-shape with the closed side of said chamber located at the open end of said firing chamber, with the two ends providing openings within which the pistons are mounted.

8. The apparatus of claim 7 wherein the two end openings of the U-shaped channel in which the pistons are mounted are of substantially cylindrical shape.

9. The apparatus of claim 7 wherein the firing chamber is provided with means for electrically detonating an explosive charge placed therein.

10. A wireline formation test tool for suspension via a cable from the surface into a fluid-filled wellbore for testing a low permeability subsurface formation which comprises an elongate body, a passageway into the body which is communicated with a pressure gage, and at least one sample chamber for testing the flow rate of connate fluids introduced into the passageway from the subsurface formation, a packer assembly constituted of a pad and pad support, each provided with concentric openings, mounted on the projecting ends of and extensible with a pair of spaced-apart pistons located on one side of the elongate body, adapted for sealing engagement by projection of the pad of the packer assembly against a wall of the formation to be tested, and alignment of the pad opening with said passageway for isolation of said passageway of the tool body from wellbore fluids, and for stabilizing and affixing the tool body in the wellbore at the level of the subsurface formation to be tested, and a jet perforator assembly, inclusive of a housing containing an open end firing chamber within which an explosive charge can be placed, and chamber provided with pistons, communicable with said passageway, located in front of the firing chamber for containing a fluid compatible with the connate fluids of said subsurface formation upon which pressure can be applied by said pistons, the housing being extended through the opening of the packer pad of said packer assembly, with the open end of the firing chamber aligned upon and facing the fluid-fillable chamber and wall of the subsurface formation to be tested, such that detonation of the explosive charge will open the fluid-filled chamber in front of the firing chamber to permit fluid to flow from said chamber into the firing chamber, and perforate the formation to establish a positive flow of connate fluids from the subsurface formation through said fluid-filled chamber and passageway into the body of the tool for testing.

11. The apparatus of claim 10 wherein the packer assembly is extensible via means of a pair of spaced apart pistons located on one side of the tool body, which is elongate and houses the passageway, pressure gage and sample chamber, and the pad is located on the outside of a support member affixed to the projecting ends of said pistons.

12. The apparatus of claim 10 wherein the means for affixing and stabilizing the tool further includes a pair of spaced-apart pistons disposed on a side of the tool body opposite that one which the packer assembly is located.

13. The apparatus of claim 12 wherein the additional pair of pistons is hydraulically actuated.

14. The apparatus of claim 10 wherein the housing of the jet perforator assembly is affixed to the packer assembly, and movable therewith such that the jet perforator assembly is positioned for perforating the subsurface formation to be tested when the pad of the packer assembly is extended and thrust against the wall of the subsurface formation to be tested.

15. The apparatus of claim 10 wherein the pad and pad support member are provided with concentric openings, the firing chamber of the jet perforator assembly is of conical shape, the fluid-fillable chamber in front of the conical shaped opening of the firing chamber is of U-shape with the closed side of said chamber located at the open end of said firing chamber, with the two ends providing openings within which the pistons are mounted, and the forward portion of the housing, within which the firing chamber and fluid-fillable container are contained, is located within the concentric openings through the pad and pad support member.

16. The apparatus of claim 15 wherein the two end openings of the U-shaped channel in which the pistons are mounted are of substantially cylindical shape.

17. The apparatus of claim 15 wherein the firing chamber is provided with means for electrically detonating an explosive charge placed therein.

* * * * *